United States Patent [19]

Murakami et al.

[11] 4,047,364

[45] Sept. 13, 1977

[54] WRAPPING PAPER STORING DEVICE IN A COIN WRAPPING MACHINE

[75] Inventors: Yasuo Murakami; Masatoshi Ushio; Hirokuni Matono, all of Himeji, Japan

[73] Assignee: Glory Kogyo Kabushiki Kaisha, Himeji, Japan

[21] Appl. No.: 723,636

[22] Filed: Sept. 15, 1976

[30] Foreign Application Priority Data

Sept. 30, 1975 Japan ..... 50-133514

[51] Int. Cl.[2] ..... B26D 7/00; B65B 41/16

[52] U.S. Cl. ..... 53/389; 83/649

[58] Field of Search ..... 53/389, 66; 83/648, 83/649

[56] References Cited

U.S. PATENT DOCUMENTS 3,546,850 12/1970 Hatanaka et al. ..... 53/389

*Primary Examiner*—Willie G. Abercrombie

*Attorney, Agent, or Firm*—Wenderoth, Lind & Ponack

[57] ABSTRACT

A compact wrapping paper storing device capable of accommodating a variety of rolls of wrapping paper has a rotary body on which a plurality of wrapping paper placing beds are radially disposed, the placing beds holding thereon respective rolls of wrapping paper in an upright attitude around wrapping paper roll supporting spindles so positioned according to the heights of the rolls of wrapping paper that the outer upper edge portions of the rolls placed on the beds lie within one and the same circle. Placing angles of the placing beds are unequally formed in a manner such that the lower surface of each adjacently preceding bed is positioned as close as possible to the inner upper edge portion of the roll placed on the succeeding bed. The device further has a cutting device adapted to cut the wrapping paper by utilization of tension produced in the wrapping paper.

2 Claims, 6 Drawing Figures

WRAPPING PAPER STORING DEVICE IN A COIN WRAPPING MACHINE

BACKGROUND OF THE INVENTION

This invention relates to coin wrapping machines and more particularly, to a wrapping paper storing device in a coin wrapping machine.

A coin wrapping machine wherein a predetermined number of coins of any kind or denomination selected from a number of kinds are stacked and wrapped in a sheet of wrapping paper to form a cylindrical package of the coins is known in the art.

In this coin wrapping machine, generally stated, the thickness of the coins to be wrapped differs with denomination, as a consequence of which stacks of coins each of a predetermined number of coins differ greatly in height, and in the case of stacks of coins of different number of coins, the coin stacks naturally differ in their height even if they are of the same denomination. Accordingly, wrapping paper having a width corresponding to the height of the stacked coins is selected for use in wrapping the coins. Since it is not desirable in terms of operational efficiency to change and use wrapping paper of widths differing in accordance with the denomination or the number of pieces of coins in the stack, there have been proposed various devices in which wrapping paper having different widths are preloaded in the coin wrapping machine, and a particular wrapping paper having a width suited for the coin stack is selected from among the wrapping paper thus preloaded and need.

For example, one conventional storing device for storing a variety of wrapping papers is disclosed (in Japanese Utility Model Publication No. 27035/1972), wherein a plurality of support plates directed sideways are projected from one side of a vertically supported rotary plate, and rolls of wrapping paper are arranged in equally spaced relation on shafts at right angles to the radius of the rotary plate so that the wrapping paper may be drawn along the surface of the rotary plate.

The afore-mentioned prior art device would be satisfactory in the case of a few kinds of rolls of wrapping paper to be stored, but if the number of kinds of rolls increases, the support plates which support the rolls of wrapping paper must be moved away from the center of the rotary plate, leading to a disadvantageous increase in the diameter of the rotary plate and therefore resulting in a large coin wrapping machine. Since the wrapping machines as described are often used in limited space such as those in banks, supermarkets, and the like, they are preferably designed as small as possible.

SUMMARY OF THE INVENTION

It is therefore an object of the present invention to provide a wrapping paper storing device in a coin wrapping machine comprising a rotary body rotatable about a shaft, on which wrapping paper placing beds for uprightly placing rolls of wrapping paper with a surface parallel to said shaft are radially disposed, roll shafts being positioned according to the height of the rolls of wrapping paper in a manner such that, when the rotary body is rotated, the outer upper edge portions of the rolls of wrapping paper placed on said placing beds all trace orbits lying within one and the same circle, placing angles of the placing beds being unequally formed in such a manner that the lower surface of each adjacently preceding placing bed is positioned as close as possible to the inner upper edge portion of the roll of wrapping paper on the succeeding placing bed, whereby a variety of rolls of wrapping paper of different paper widths can be stored with minimum diameter of the rotary body.

DETAILED DESCRIPTION

Figure 1:
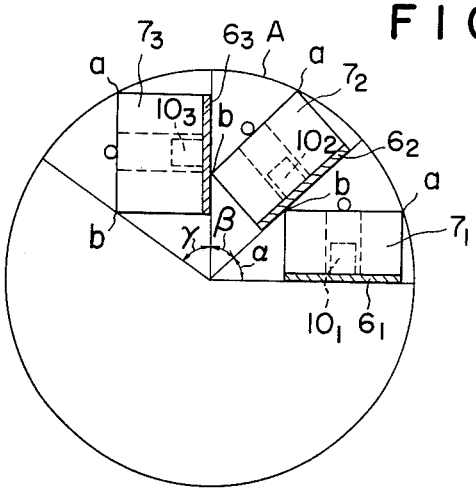
FIG. 1 is a schematic diagram indicating the basic concept of a wrapping paper storing device in accordance with this invention.
Figure 2:
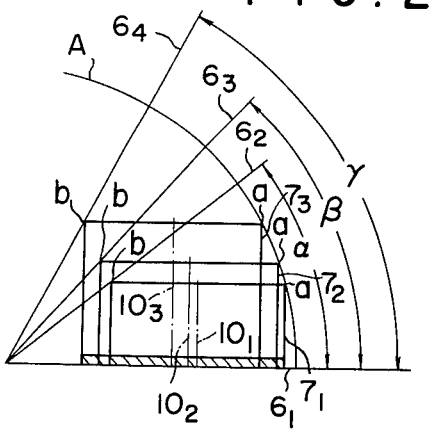
FIG. 2 is a diagram for an explanation of the concept indicated in FIG. 1.
Figure 3:
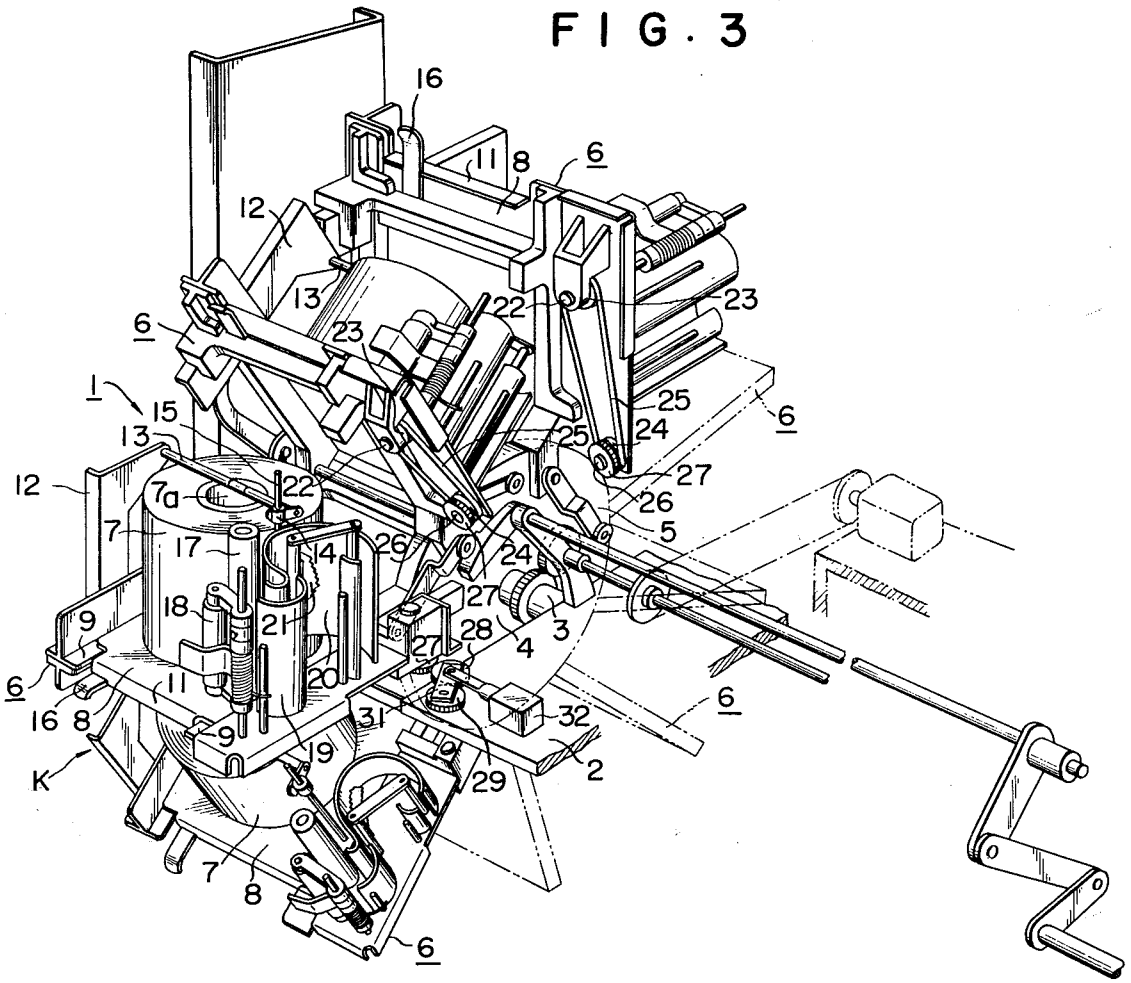
FIG. 3 is a perspective view showing a specific example in concrete form of the device indicated in FIG. 1.

Turning first to FIG. 3, there is shown a specific example of a wrapping paper storing device 1 in accordance with the present invention having a rotary shaft 3 rotatably supported in a horizontal direction on a machine body 2 of a coin wrapping machine. A flanged rotary body 4 is mounted on the rotary shaft 3, and wrapping paper roll placing beds 6, 6 . . . are radially disposed on flange portions 5, 5 of the rotary body 4. Each placing bed 6 has a placing plate 8 retractably mounted thereon, the placing plate 8 uprightly placing thereon a wrapping paper roll 7 from the radial extremity. That is, the placing bed 6 has rail portions 9 and 9 on the right and left hands thereof, and grooves (not shown) formed in the opposite sides of the placing plate 8 are fitted in the rail portions 9 and 9 for slidable movement. In a substantially central portion of the upper surface of the placing plate 8 there is provided a wrapping paper roll supporting spindle 10 (FIG. 2) to receive a center hole 7a of the wrapping paper roll 7, and at the edge end of the placing plate 8 there is formed a bent hand grip 11.

The placing beds 6, 6 . . . are arranged adjacent to one another to the extent that the lower surface of the upper placing bed 6 will not come in contact with the inner upper edge portion *b*of the wrapping paper roll 7 in a range such that the outer upper edge portions *a* of the wrapping paper rolls 7, 7 . . . different in their heights to be placed on the placing plates 8 are inscribed in a phantom circle A with its center at the centerline of the rotary shaft 3 thereby to determine mounting angles based on the height of the wrapping paper rolls 7 to be charged.

This will be described in detail with reference to FIG. 2. In the case of wrapping paper rolls $7_1$, $7_2$ and $7_3$, for example, the wrapping paper roll supporting shafts $10_1$, $10_2$ and $10_3$ of the placing beds 6 are so positioned that the outer upper edge portions $1_1$, $1_2$ and $A_3$ of the wrapping paper rolls $7_1$, $7_2$ and $7_3$ are inscribed in the phantom circle A, and in he shortest wrapping paper roll $7_1$, and angle $\alpha$ is formed between the placing bed $6_1$ and the upper placing bed $6_2$. In the succeeding wrapping paper roll $7_2$, an angle $\beta$ is formed relative to the upper placing bed $6_3$, and in the tallest wrapping paper roll $7_3$, an angle $\gamma$ is formed relative to the upper placing bed $6_4$ thereby to determine mounting angles of the placing beds $6_1$, $6_2$ . . . , respectively.

As shown in FIG. 3, on the upper surface at one side of the placing bed 6, a brace 12 is mounted adjustably in height by means of a set screw and a slot (not shown). At the upper part of the brace 12, a keep member 13, which prevents disengagement of the wrapping paper roll 7, is mounted diametrically of the upper surface of the wrapping paper roll 7 uprightly placed with the center hole 7a received on the wrapping paper supporting spindle 10 of the placing bed 6. On the other end of the keep member 13 is mounted a guide bush 14, which is extended through a guide post 15 erected on the other side of the brace 12 to firmly support the keep member 13.

A locking lever 16 of a resilient material adapted to lock the placing plate 8 in position is provided at the front end of the placing bed 6 so that when the lever is pressed down, the placing plate 8 can be unlocked and placed in a pull-out condition.

On the upper surface at one side of each placing bed 6, there are provided a pair of paper feed rollers 17, 18 for holding and feeding the wrapping paper, curved guide plates 19, 20 for feeding the wrapping paper, in a slackened condition, delivered by the paper feed rollers 17, 18 and a cutter 21 having an angular cutting edge positioned in a passage of the wrapping paper and affixed to a wrapping winding device in the wrapping machine to cut the wrapping paper by a tension applied to the paper.

Figure 4:
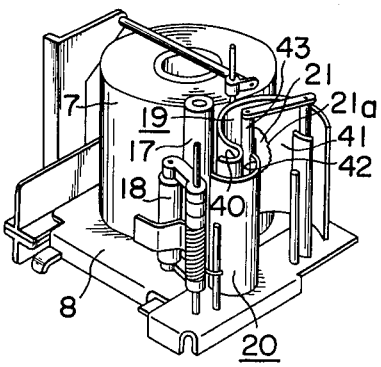
FIG. 4 is a perspective view of one example of a wrapping paper cutting device in the wrapping paper storing device in accordance with the present invention.

The aforementioned cutter device will further be discussed in detail hereinafter with reference to FIG. 4.

The wrapping paper roll 7 is shown placed on the placing plate 8. At the side of the wrapping paper roll 2, the pair of paper feed rollers 17, 18 are erected in mutual pressure contact so that rotation of one roller 17 causes the other roller 18 to rotate, thereby feeding the wrapping paper held between the two rollers 17 and 18 toward coin wrapping rollers (not shown). On the downstream side of the paper feed rollers 17 and 18 in the direction of paper feed, the pair of guide plates 19 and 20 are disposed in spaced apart relation.

The guide plate 19 is formed with a curved portion 40 of a small diameter at its end nearest the paper feed rollers, and the remainder part of the guide plate 19 is formed as a curved portion 41 of a large radius of curvature opposite in curved direction to that of the curved portion 50, the curved portion 41 being mounted on the placing plate 8. On the other hand, the guide plate 20 is formed with a curved portion 42 of a large radius of curvature curved in the same direction as that of the small-radius curved portion 40 of the guide plate 19, and the wrapping paper is fed along the inside of the concave curved portion 42. The guide plate 20 is so adapted that it can be moved by the operation of a denomination setting knob (not shown) or the like so as to adjust the spacing between the guide plate 20 and the small-radius curved portion 40 of the guide plate 19.

The large-radius curved portion 41 of the guide plate 19 is internally provided with the cutter 21 supported on a shaft 43 in such a manner that a cutting edge 21a at the extremity of the cutter is in the proximity of the guide plate 19. The cutter 21, which is formed of a relatively resilient material, may also be designed to be rotatable about the shaft 42 according to the outer diameter of the coins or may be entirely fixedly supported on the shaft 42.

Referring again to FIG. 3, the lower end of the driving roller 17 of the above mentioned paper feed rollers extends through the lower surface of the placing bed 6 to form an extended shaft 22 on which a pulley 23 is mounted, and an endless best 25 is passed over this pulley 23 and another rotation transmitting pulley 24 positioned at the lower surface on the machine body 2 side of the placeing bed 6 and fixed to a shaft 26. On this shaft 26 is mounted a rotation transmitting gear 27, which is engageable with a rotation transmitting gear 28 positioned on the machine body 2 side. This rotation transmitting gear 28 is supported by a lever 31 attached to a shaft 30 of a driving gear 29, the lever 31 being coupled to an actuating rod of a solenoid 32 so that when the solenoid 32 is actuated, the gear 28 assumes a position such that it meshes with the rotation transmitting gear 27.

The operation of the embodiment of the invention shown in FIG. 3 will be described below.

In loading the wrapping paper rolls 7, 7 . . . on the corresponding placing beds 6, 6 . . . of the wrapping paper storing device 1, each placing bed 6 to be loaded is adjusted to a paper feed position (in the direction of K in FIG. 2), after which the locking lever 16 is depressed to unlock the placing plate 8 so that it can be pulled out, and the center hole 7a of the wrapping paper roll 7 having the proper paper width to be placed on the placing bed 6 is fitted round the support spindle 10 to place the roll of paper in upright state, and the placing plate 8 is pushed back. When the placing plate 8 is moved back in position on the placing bed 6, the placing plate 8 is unretractably locked by the locking lever 16. Then, the keep member 13 is placed on the upper surface of the wrapping paper roll 7, and the brace 12 is locked by the set screw to retain the wrapping paper roll 7. In this manner, the wrapping paper rolls 7, 7 . . . corresponding to the placing beds are similarly loaded onto the placing beds 6, 6 . . . In the position as indicated at K in FIG. 3, the wrapping paper pulled out of the roll of paper 7 passes between the paper feed rollers 17 and 18 and is pulled out through the space between the guide plates 19, 20.

The cutter device operates in the following manner. When the paper feed rollers 17 and 18 are driven, the wrapping paper 45 held between these rollers 17 and 18 is successively pulled out of the wrapping paper roll 7, and as shown in FIG. 5, the wrapping paper travels along the curved internal concave surface of the guide plate 20 and then along the internal surface of the large-radius curved portion 41 of the guide plate 19 and is fed toward the coin wrapping rolls (not shown), passing between guide rollers 44, 44.

Figure 6:
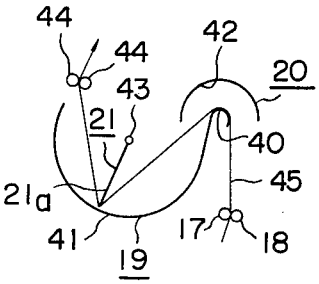

Then, after a predetermined period of time has elapsed, the paper feed rollers 17 and 18 stop, and serve as brakes for wrapping paper 45. On the other hand, the leading extremity of the wrapping paper 45 is wound round stacked coins (not shown) so that the wrapping paper 45 assumes a stretched state as shown in FIG. 6. This tension of the wrapping paper 45 is utilized to cut the paper 45 by means of the cutting edge 21a of the cutter 21.

Figure 5:
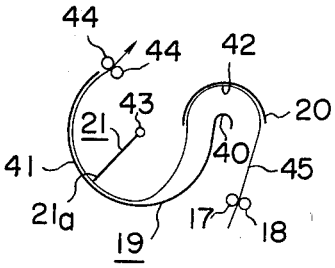
FIGS. 5 and 6 are diagrammatic explanatory views respectively showing states wherein wrapping paper is fed and tensioned for cutting.

Incidentally, the wrapping paper 45 is stretched when the paper 45 is moved from its state where it comes in contact with the inner side of the guide plate 20 as shown in FIG. 5 to its state where it comes in contact with the outer convex side of the small-radius curved portion 40 of the guide plate 19. Therefore, the spacing between the small-radius curved portion 40 of the guide plate 19 and the curved portion 42 of the guide plate 20 may be decreased by moving the guide plate 20 to thereby curtail the time required to stretch the wrapping paper 45 and to reduce the length of the wrapping paper 45 thus cut off. Conversely, the spacing between the small-radius curved portion 40 of the guide plate 19 and the curved portion 42 of the guide plate 20 may be increased to thereby lengthen the length of the wrapping paper 45 cut off. However, since the guide plate 20 is coupled in association with, for example, the denomination knob as previously mentioned, the spacing between the guide plates 19 and 20 is automatically set depending upon the diameter of coins, and, hence, the wrapping paper 45 is cut into pieces of the desired length suitable for the diameter of coins.

Although the guide plate 19 is fixed, while the guide plate 20 is adapted to be movable in the above described example, it will be apparent that the guide plate 19 may be adapted to be movable, while the guide plate 20 is fixed.

In the wrapping paper storing device 1, the wrapping paper for those coins as classified by their denomination is moved by a control mechanism (not shown) when the denomination of coins to be wrapped is set until the wrapping paper assumes the paper feed position K. When the placing bed 6, on which the wrapping paper roll 7 is retained, is positioned at the position K, the solenoid 32 is actuated to cause the rotation transmitting gear 28 to mesh with the gear 27 on the placing bed 6 side through the lever 31. The driving gear 29 is then rotated to transmit rotation to the driving roller 17 of the paper feed follers 17 and 18 through the pulley 24, the belt 25 and the pulley 23, and the wrapping paper is pulled out by the roller 17 in cooperation with the follower roller 18 and is fed toward the coin wrapping device in the wrapping machine.

In accordance with the present invention, as described above, there is provided an arrangement comprising a rotary body rotatable about a shaft, on which wrapping paper placing beds for uprightly placing rolls of wrapping paper each with a surface parallel to said shaft are radially disposed, wrapping paper roll supporting spindles being arranged according to the height of the rolls of wrapping paper in such a manner that, when the rotary body is rotated, by the outer upper edge portions of the rolls of wrapping paper placed on said placing beds trace orbits lying in one and the same circle, placing angles of the placing beds being unequally formed in such a manner that the lower surface of each adjacently preceding placing bed is positioned as close as possible to the inner upper edge portion of the roll of wrapping paper on the succeeding placing bed. By this arrangement, a variety of rolls of wrapping paper different in paper width can be efficiently stored within a small space without increasing the diameter of the rotary body thereby to materially decrease the space occupied by the wrapping paper storing section when the device is accommodated in the coin wrapping machine, thus affording a great advantage in reducing the size of the entire wrapping machine.

While the base portions of the placing beds have been shown supported on the rotary body to be disposed in the radial direction in the illustrated example, the device may, of course, be so designed that one side of each placing bed is supported on one side face of the rotary body. Furthermore, the placing beds may be supported on arms radially disposed on the rotary body.

We claim:

1. A wrapping paper storing device in a coin wrapping machine, comprising a rotary body rotatable about a shaft, a plurality of wrapping paper placing beds for placing thereon rolls of wrapping paper with axes perpendicular to respective placing beds, said placing beds lying in planes radially disposed relative to said shaft, wrapping paper roll supporting spindles so positioned according to the height of respective rolls of wrapping paper that, when said rotary body is rotated, the outer upper edge portions of the rolls of wrapping paper placed on said placing beds trace orbits lying in one and the same circle, placing angles of the placing beds being unequally formed in such a manner that the lower surface of each adjacently preceding placing bed is positioned as close as possible to the inner upper edge portion of the roll of wrapping paper on the succeeding placing bed.

2. A wrapping paper storing device according to claim 1 further comprising a wrapping paper cutting device which comprises a pair of wrapping paper feed rollers adapted to be rotated while holding therebetween the wrapping paper from a roll of wrapping paper thereby to feed said wrapping paper, a cutter disposed in a path of the wrapping paper down-stream of said rolls of wrapping paper, said wrapping paper being cut by said cutter when said feed rollers stop to tension said wrapping paper, a first curved guide plate disposed in a path of the wrapping paper between said rollers and said cutter to feed the wrapping paper along the inner surface of said curved guide plate, and a second curved guide plate disposed in spaced-apart relation with said first guide plate, whereby when the wrapping paper is tensioned, said wrapping paper comes in pressing contact with said second guide plate, one of said guide plates being movable so as to be variable in spacing with respect to the other guide plate.

* * * * *